US005219385A

United States Patent [19]

Yeh

[11] Patent Number: 5,219,385

[45] Date of Patent: Jun. 15, 1993

[54] LOCK FOR FIRE-ESCAPE DOOR

[75] Inventor: Ching H. Yeh, Taipei, Taiwan

[73] Assignee: Catwin Industrial Corporation, Taipei, Taiwan

[21] Appl. No.: 977,461

[22] Filed: Nov. 17, 1992

Related U.S. Application Data

[63] Continuation-in-part of Ser. No. 890,336, May 26, 1992, abandoned, which is a continuation of Ser. No. 627,134, Dec. 13, 1990, abandoned.

[51] Int. Cl.[5] ..... E05B 65/10

[52] U.S. Cl. ..... 70/92; 292/92; 292/169.13; 292/169.14

[58] Field of Search ..... 70/92, 465; 292/21, 292/92, 169.13, 169.14, 169.17, 169.18, DIG. 65

[56] References Cited

U.S. PATENT DOCUMENTS

| | | | |
|---|---|---|---|
| 2,824,440 | 2/1958 | Jewett et al. | 292/92 X |
| 3,877,262 | 4/1975 | Williams | 292/92 X |
| 4,458,928 | 7/1984 | Hirschbein | 292/92 |
| 4,545,606 | 10/1985 | Vodra | 292/92 |
| 4,709,950 | 12/1987 | Zortman | 70/92 X |
| 4,801,163 | 1/1989 | Miller | 292/92 |

*Primary Examiner*—Lloyd A. Gall
*Attorney, Agent, or Firm*—Lowe, Price, LeBlanc & Becker

[57] ABSTRACT

A lock for fire-escape door provided with an actuating member having an integrally formed tongue to block the retraction of a main latch from a protruded position provides higher security to the lock. The lock includes: a housing; a pivotable main latch and a pivotable auxiliary latch which are urged by springs to protrude outside of the housing; and an actuating member adapted to keep the main latch protruded out of the housing and operable with a push plate to release the main latch from being kept protruded. The auxiliary latch has a side projection which stops the actuating member at a first position where the auxiliary latch is protruded and the tongue is so disposed to be accommodated by an inner recess of the main latch such that the main latch is free to retract from the protruded position; the same side projection also stops the actuating member at a second position where the auxiliary latch is retracted and the main latch is protruded. At that second stop position a tongue of the actuating member is disposed immediately behind the main latch to block the retraction of the main latch from the protruded position.

2 Claims, 7 Drawing Sheets

LOCK FOR FIRE-ESCAPE DOOR

This application is a continuation-in-part application of U.S. Pat. application No. 07/890,336, filed May 26, 1992, which is a continuation application of U.S. Pat. application No. 07/627,134, filed Dec. 13, 1990; both of the U.S. Pat. Application Nos. 07/890,336 and 07/627,134 are now abandoned.

BACKGROUND OF THE INVENTION

The present invention relates to an exit door lock and more particularly to an emergency fire-escape door lock.

Exits which are normally kept closed and locked in a building must be provided with a lock capable of being rapidly unlocked from the inside in case there is a fire or other emergency in the building. There are many kinds of locks available in the market for such purpose; these locks, however, suffer from the following disadvantages:

1) Although the lock can rapidly be unlocked from indoors, it can also easily be picked from the outside by a thief using a tool, or the lock will automatically become unlocked if the exit door is subjected to a relatively large impact force so as to cause the latch of the lock to disengage from the door strike plate by shock; the lock is thus not very effective in maintaining security.

2) Although some locks are designed such that their locking members have additional protection, most of them still have such disadvantages as: a relatively large number of parts; a complicated structure; a relatively high cost; a relatively difficult assembling procedure; and a low reliability.

SUMMARY OF THE INVENTION

It is therefore an object of the present invention to provide an exit door lock that is simple in both structure and assembling procedure.

It is further an object of the present invention to provide an exit door lock that is effective in maintaining security.

According to the present invention, the lock includes a housing having a mounting frame on which a main latch and an auxiliary latch are pivotally mounted, the main latch and the auxiliary being capable of pivotally moving between a protruded position and a retracted position. The main latch has a front part and a rear part and is urged by a first torsion spring toward the protruded position; the auxiliary latch has a side protrusion and is urged by a separate, second torsion spring toward the protruded position. An actuating member having a front end and a rear end is pivotally mounted on the mounting frame, the front end of the actuating member having a tongue, a finger and a concave at the lower part of the finger. The actuating member is urged by a third torsion spring to move pivotally from an unlocking position where the tongue is engaged with a lower part of the rear part of the main latch at the retracted position and the front end of the actuating member is disengaged from the side protrusion of the auxiliary latch, to a first stop position where the finger of the front end of the actuating member is engaged with the side protrusion of the auxiliary latch at the protruded position to stop the front end of the actuating member such that the tongue is disposed to correspond with an inner recess of the mail latch to allow the main latch to pivotally move from the protruded position to the retracted position when the main latch is pushed to retract from the protruded position, and also to a second position where the concave of the finger of the actuating member is engaged with the side protrusion of the auxiliary latch at the retracted position to stop the front end of the actuating member such that the tongue is disposed immediately behind a lower part of the main latch at the protruded position to block the retraction of the main latch from the protruded position.

A push plate is provided to operate the actuating member for unlocking the lock.

The present invention may best be understood through the following description with reference to the accompanying drawings, in which:

DETAILED DESCRIPTION OF THE PREFERRED EMBODIMENT

Figure 1:
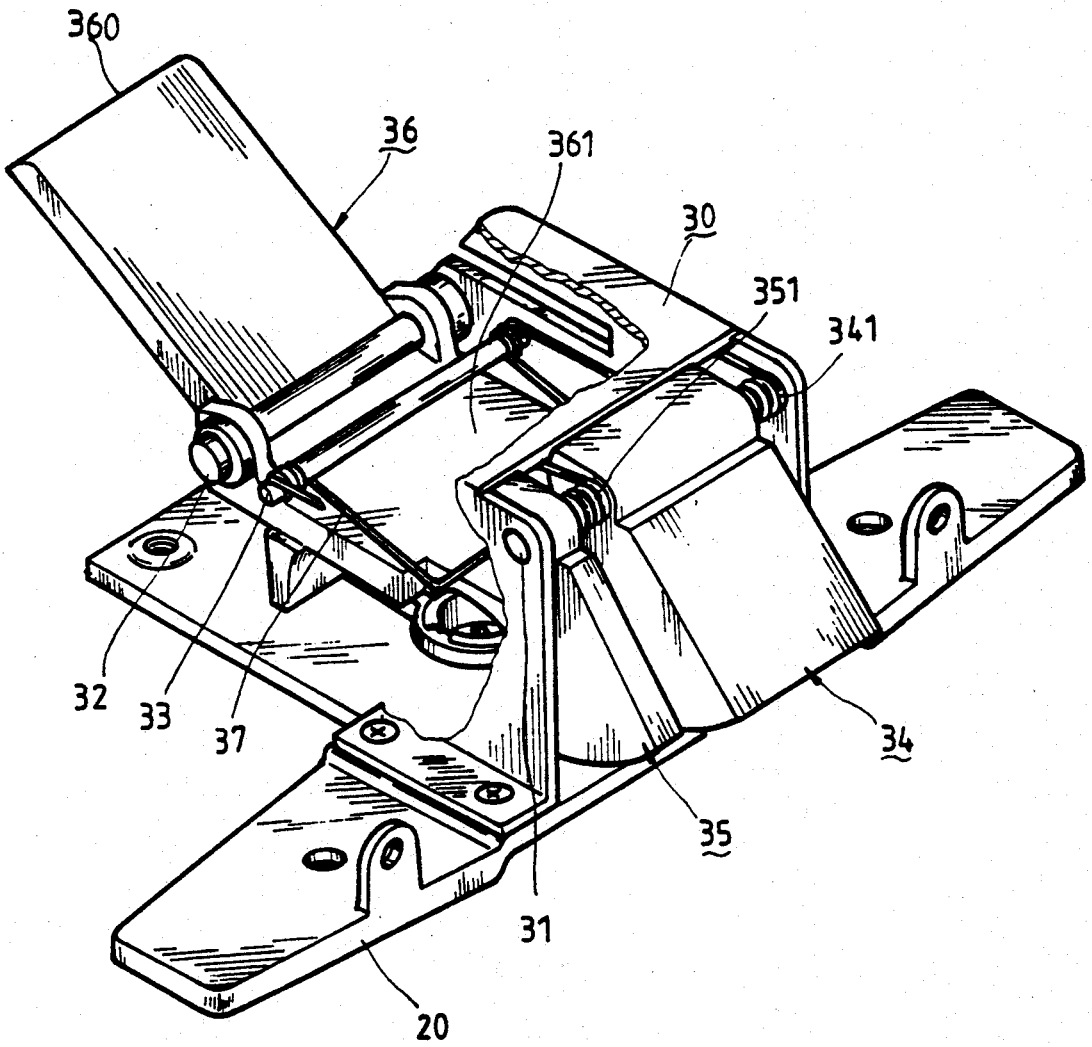
FIG. 1 is a fragmentary perspective view showing an exit door lock according to the present invention.

Referring now to FIGS. 1–6, a first embodiment of the fire escape door lock according to the present invention includes: a housing 10 having a base 20 and a mounting frame 30; a first positioning shaft 31 mounted on the frame 30; a main latch 34 pivotally mounted on first positioning shaft 31, an auxiliary latch 35 pivotally mounted on the same first positioning shaft 31 and at one side of main latch 34; a first torsion spring 341 at one side of main latch 34 and sleeved on first positioning shaft 31 to urge main latch 34 to move pivotally in a forward direction (a counterclockwise direction as viewed in FIG. 2) such that a front part 34F of main latch 34 is urged to protrude from housing 10 to a protruded position; a second torsion spring 351 sleeved on first positioning shaft 31 and disposed between main latch 34 and auxiliary latch 35 to urge auxiliary latch 35 to move pivotally in a forward direction such that a front part of auxiliary latch 35 is urged to protrude from housing 10 to a protruded position; an actuating member 36 pivotally mounted on a second shaft 32 which is mounted on frame 30 and in parallel with first positioning shaft 31; a third torsion spring 37 sleeved on a third positioning shaft 33 mounted on frame 30 for urging actuating member 36 to move pivotally in a rearward direction (a clockwise direction as viewed in FIG. 2), actuating member 36 being disposed behind main latch 34. Housing 10 has an opening 10A (FIG. 2) which allows a rear end 360 of actuating member 36 to extend through opening 10A. A push plate 4 is operatively mounted on the door on which the door lock is mounted to correspond with rear end 360 of actuating member 36. Second torsion spring 351 provides a space between the two neighboring sides of main latch 34 and auxiliary latch 35.

Figure 2:
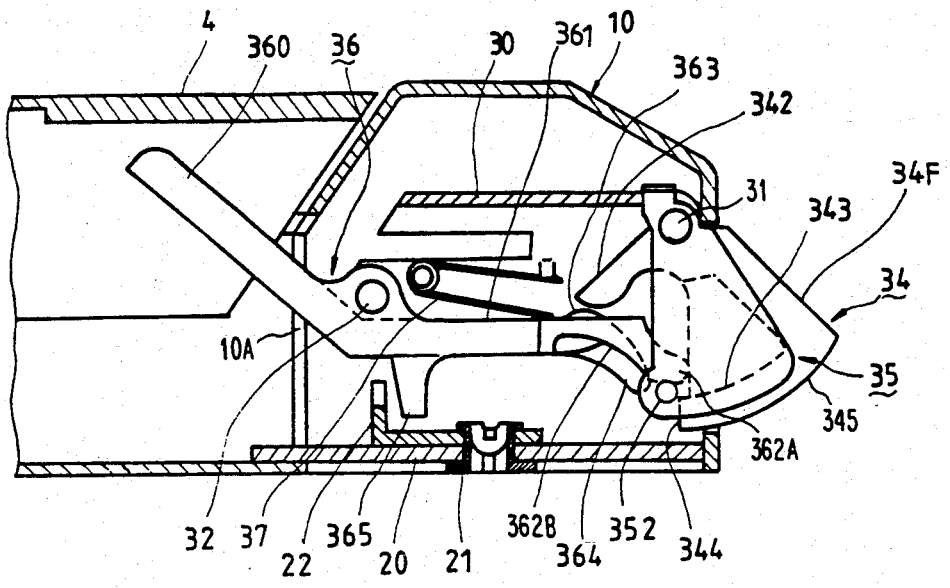
FIG. 2 is a sectional view showing the lock of FIG. 1; wherein the actuating member is at the first stop position.
Figure 3:
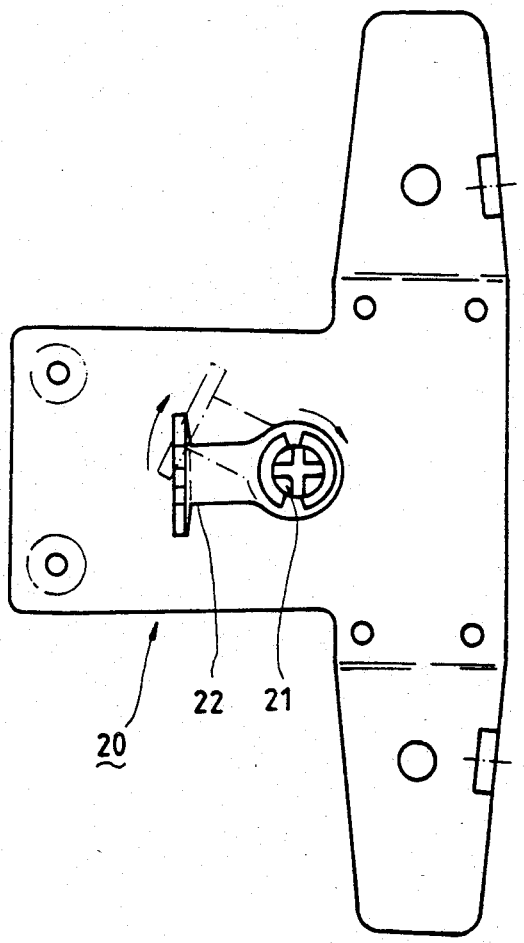
FIG. 3 is a top view showing the base of the lock of FIG. 1.

As shown in FIG. 2, main latch 34 has a front part 34F which faces the outside of frame 30, a rear part 342 which faces the inside of frame 30, and lower part 345 extended inwardly from a lower end of front part 34F to define an inner recess 343 formed at the rear side of front part 34F. First positioning shaft 31 passes through an upper part of main latch 34. Lower part 345 has a rear edge 344.

Auxiliary latch 35 has an upper part through which first positioning shaft 31 passes, and a side protrusion 352 extending from one side of a lower part of auxiliary latch 35 toward the neighboring side of main latch 34.

Figure 2A:
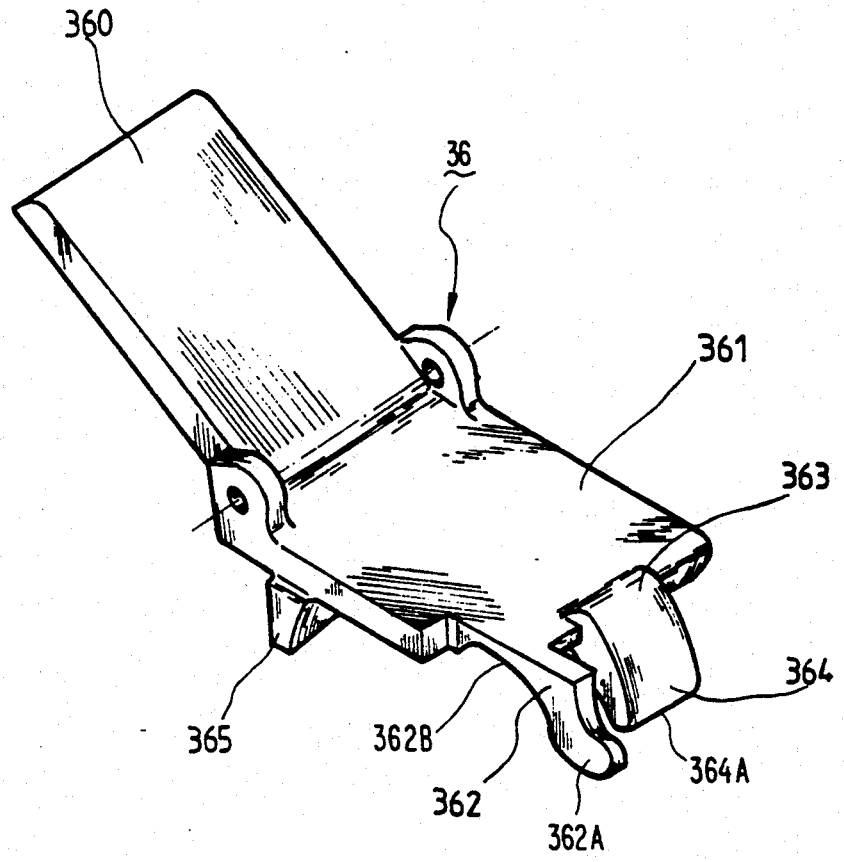
FIG. 2A is a perspective view showing the actuating member of the lock of FIG. 1.

Actuating member 36 has a rear end 360 extending away from main latch 34, and an opposite, front end 361 extending toward main latch 34, front end 361 having a tongue 364 and a finger 362 forming integral parts of front end 361 of actuating member 36. Finger 362 has a tip 362A and a concave 362B at a lower side of finger 362 and adjacent to tip 362A, as shown in FIG. 2A. Tongue 364 has an upper ridge 363 corresponding with the lower end of rear part 342 of main latch 34; tongue 364 also has a front end 364A (FIG. 2A) to be further described later.

Finger 362 of front end 361 of actuating member 36 extends in between main latch 34 and auxiliary latch 35. When both of main latch 34 and auxiliary 35 are at the protruded position as shown in FIG. 2, tip 362A of finger 362 engages with side protrusion 352 of auxiliary latch 35 so as to define a first stop position of actuating member 36. At this first stop position, tongue 364 is disposed to correspond with inner recess 343 of main latch 34, so that main latch 34 can be pushed from outside to a retracted position where tongue 364 is accommodated by inner recess 343 of main latch 34. Concave 362B of finger 362 is adapted allow side projection 352 to slide and depart from tip 362A of finger 362 of actuating member 36 when auxiliary latch 35 is pushed to move pivotally from the protruded position to the retracted position while main latch 34 is at protruded position, where actuating member 36, being urged by a third torsion spring 37, is allowed to move clockwise further from the above said first stop position until concave 362B of finger 362 engages with side projection 352 of auxiliary latch 35 to define a second stop position of actuating member 36. At this second stop position, tongue 364 is disposed such that front end 364A of tongue 364 corresponds with rear edge 344 of lower part 345 of main latch 34 which remains at the protruded position, so as to block the retracting movement of main latch 34 from the protruded position.

Front end 361 of actuating member 36 has a driving piece 365 extending from the lower side of front end 361.

Figure 6:
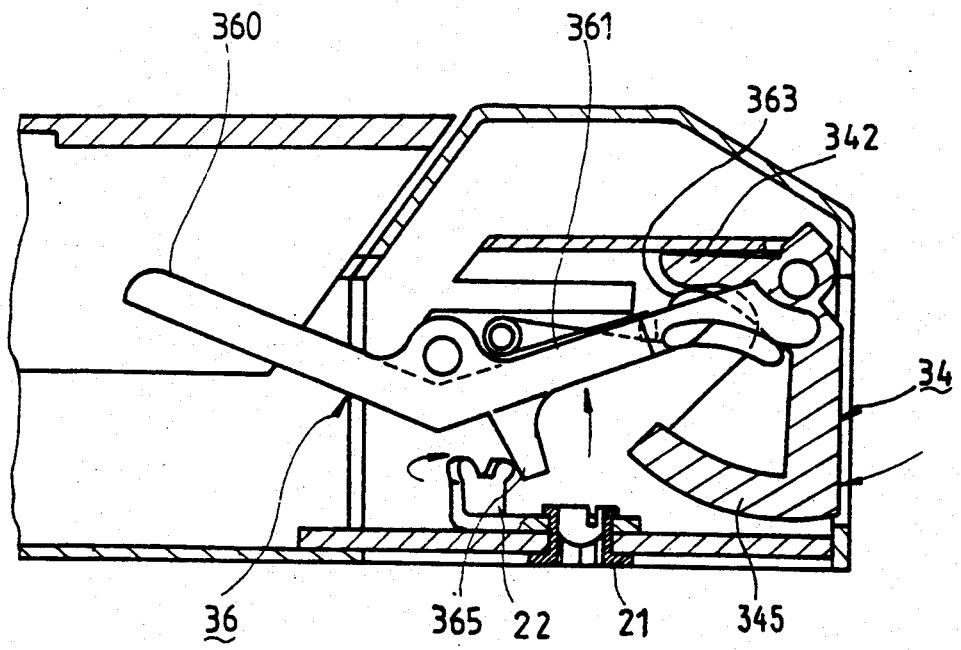
FIG. 6 is a schematic view showing the lock of FIG. 1 being unlocked with a key.

A tumbler 21 operable with a matching key is mounted on base 20, and a hooking piece 22 having an upright member is connected to tumbler 21. As shown in FIG. 6, when tumbler 21 is rotated with a matching key, not shown, hooking piece 22 is rotated to push driving piece 365 of actuating member 36 to move to the unlocking position.

Figure 2B:
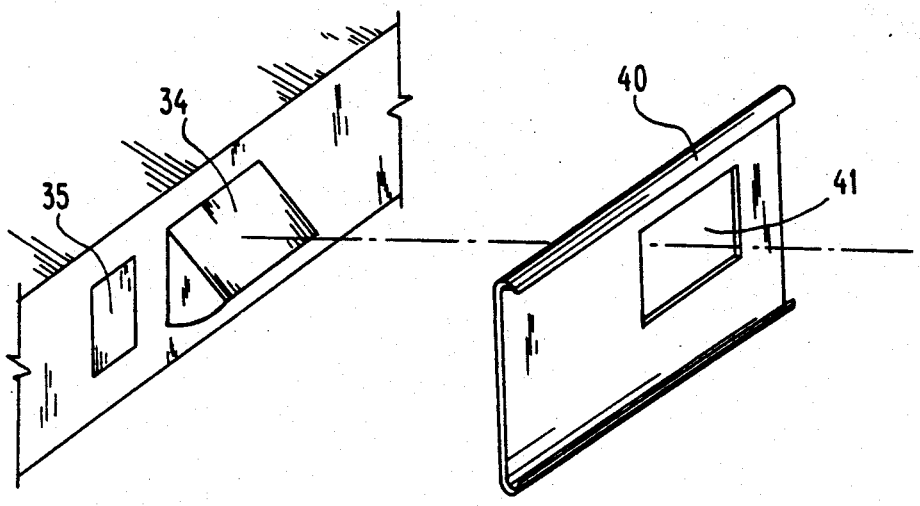
FIG. 2B is a perspective view showing the door strike plate in relation with the main latch and the auxiliary latch of the lock.

The door lock of this invention is to be used in association with a door strike plate 40 fixed on a door jamb, not shown, the door strike plate 40 having a hole 41 only allowing main latch 34 to protrude when the door is completely closed, and there is no hole in the door strike to allow auxiliary latch 35 to protrude while the door is closed. Such a door strike plate 40 is shown in FIG. 2B.

The operation of the first embodiment of the fire-escape door lock is now described as follows:

When the fire-escape door, incorporating thereon the door lock of this invention is open, main latch 34 and auxiliary latch 35 are both in a protruded position, as shown in FIG. 2, where actuating member 36 is at the above-described first stop position. When the fire-escape door is closed, main latch 34 and auxiliary latch 35 are both first forced by an edge part of strike plate 40 to retract before the door is moved to a completely closed position. During this door closing process, main latch 34 is moved to the retracted position where tongue 364 extends into inner recess 343 of main latch 34, and auxiliary 35 is also moved to the retracted position where side projection 352 of auxiliary latch 35 is caused to disengage from the tip 362A of finger 362, as described above, so as to relieve front end 361 of actuating member 36 from being stopped at the above-said first stop position; but tongue 364 remains being accommodated in inner recess 343 of main latch 34 until the door is moved to the completely closed position where main latch 34 is aligned with the hole 41 of the strike plate 40 and allowed to protrude.

Figure 4A:
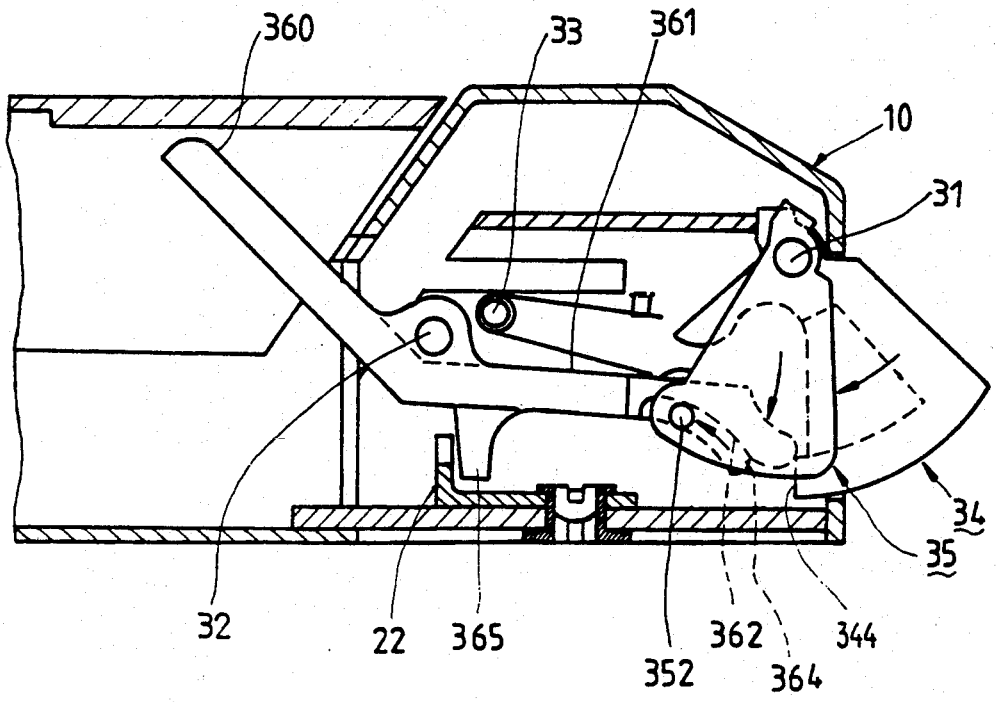
FIG. 4A is a schematic view showing the lock of FIG. 1 when an exit door, incorporating thereon the lock, is completely closed and locked, and the actuating member is at the second stop position.
Figure 4B:
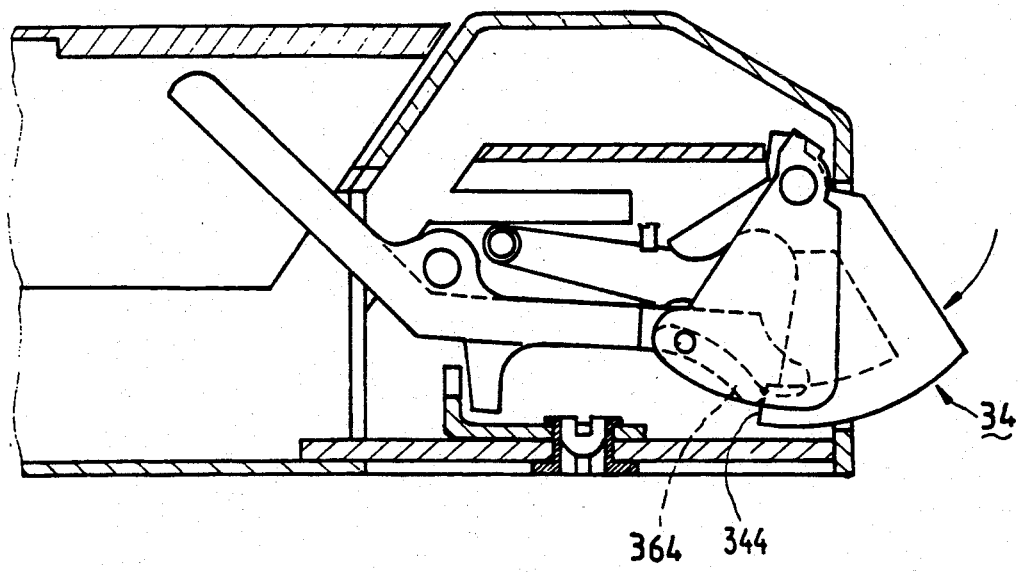
FIG. 4B is a schematic view showing the state that the actuating member blocks the retraction of the main latch of the lock of FIG. 1 from the protruded position while the door is completely closed and an attempt is made to open the door by force without unlocking the lock.

As soon as the door is completely closed, main latch 34 is urged by first torsion spring 341 to protrude into the hole 41 of the strike plate 40 while auxiliary latch 35 remains at the retracted position, where side projection 352 is moved rearwards and tongue 364 of front end 361 of actuating member 36 is caused to depart from inner recess 343 of main latch 34. Front end 361 of actuating member is urged by third torsion spring 37 to move further downward to the above-described second stop position, where concave 362B of finger 362 of front end 361 of actuating member 36 engages with side projection 352 of auxiliary latch 35 which remains at the retracted position. Such movement of actuating member 36 to the second stop position also causes tongue 364 to move to such position where front end 364A of tongue 364 is disposed immediately behind inner edge 344 of lower part 345 of main latch 34, as shown in FIG. 4A. In this state, if main latch 34 is forced to move pivotally inwards from the protruded position as in the case someone is plying main latch 34 or attempting to open the door by force without unlocking the lock, the inner edge 344 of lower part 345 of main latch 34 will be caused to abut the front end 364A of tongue 364 of actuating member 36 at the second stop position; as a result, the inward movement, or retracting movement of main latch 34 is blocked, and the door lock is kept locked.

Figure 5:
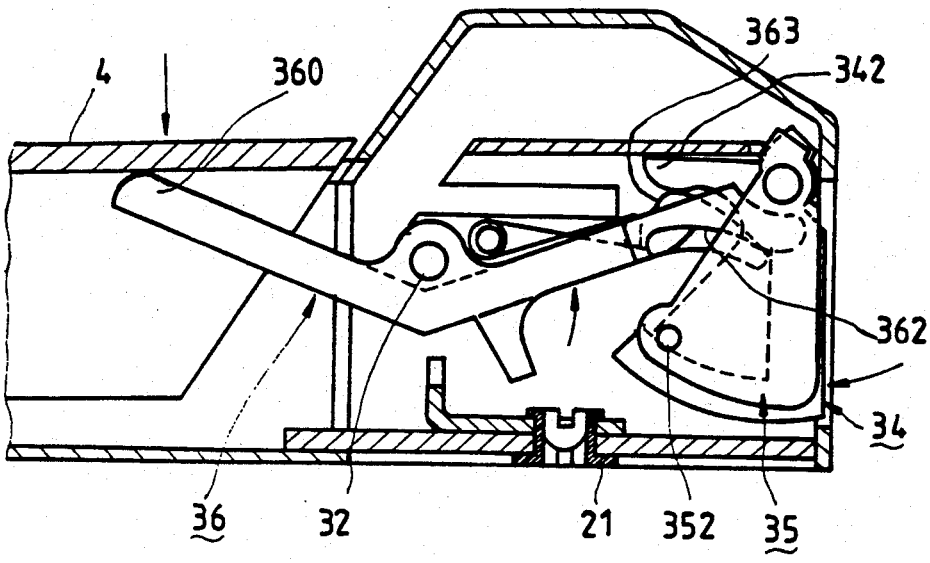
FIG. 5 is a schematic view showing the lock of FIG. 1 when the push plate therein is pushed and the actuating member is at the unlocking position.

To unlock the door lock, push plate 4 on the indoor side of the door is pushed to depress rear end 360 of actuating member 36, as shown in FIG. 5. Then, actuating member 36 is rotated in a counterclockwise direction causing tongue 364 of actuating member 36 to move upwards. As a result, front end 364A of tongue 364 is disengaged from rear edge 344 of lower part 345 of main latch 34, and at the same time, upper ridge 363 of tongue 364 pushes inner part of 342 of main latch 34, causing main latch 34 to move pivotally clockwise with respect to first positioning shaft 31, or to retract from the protruded position. The door lock is thereby unlocked.

The door lock may also be unlocked by rotating tumbler 21 with a matching key (not shown), as shown in FIG. 6, such that hooking piece 22 is rotated to cause the upright member to push driving piece 365 of actuating member 36 to cause actuating member 36 to rotate in a counterclockwise direction from the second stop position, such that tongue 364 is caused to push upwards inner part of 342 of main latch 34 to cause main latch 34 to retract from the protruded position, so as to unlock the lock.

Tumbler 21 can be any type of conventional cylinder locks and thus, the description of its detailed construction is omitted.

Figure 7:
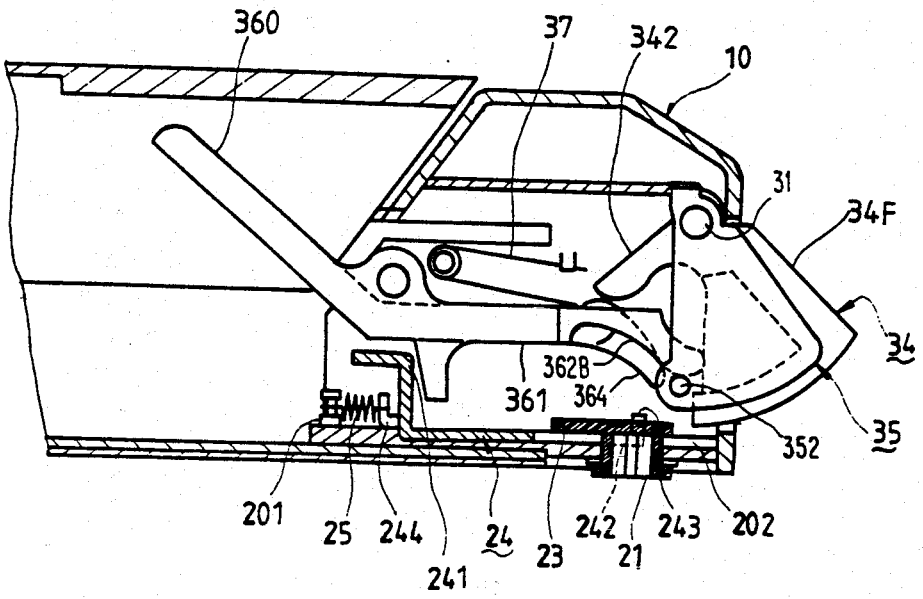
FIG. 7 is a sectional view showing a second embodiment of the exit door lock according to the present invention.
Figure 8:
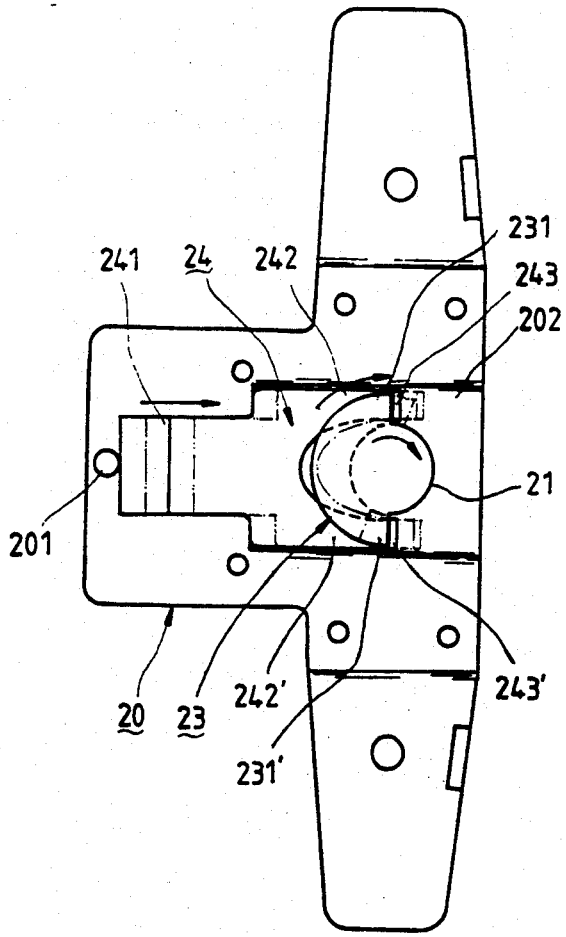
FIG. 8 is a top view showing the base of the lock of FIG. 7.
Figure 9:
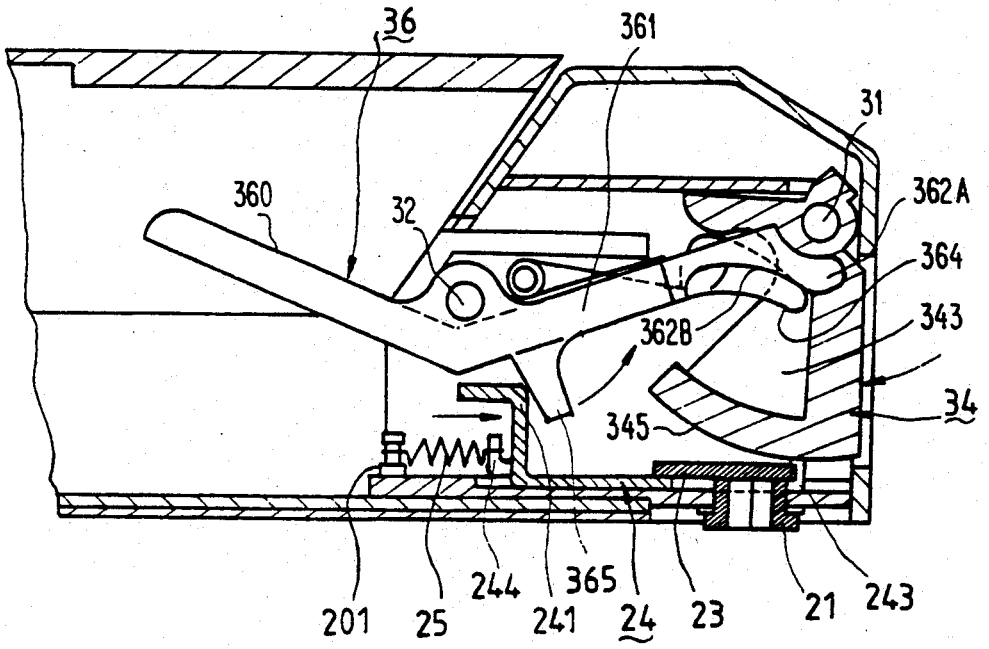
FIG. 9 is a schematic view showing the lock of FIG. 7 being unlocked with a key.

FIGS. 7–9 show a second embodiment of a fire-escape door lock according to the present invention, which has a sliding groove 202 (FIG. 8) on base 20, and an operating piece 24 is includes a raised end 241 disposed adjacent to driving piece 365, and an opposite forked end having two forky elements 242, 242' provided with hooks 243 and 243'. Tumbler 21 is provided with a cam 23 forming two opposite shoulders 231 and 231' engageable with hooks 243 and 243' respectively. A restoring spring 25 is mounted between a hook 244 fixed to raised end 241 and a projection 201 secured to base 20.

When tumbler 21 and cam 23 are rotated, the engagement of shoulder 231/231' and element 242/242' will cause operating piece 24 to slide and raised end 241 is caused to push driving piece 365 of actuating member 36 to unlock the door in a manner similar to that of the first embodiment. Restoring spring 25 will return operating piece 24 into position when tumbler 21 is free.

In summary, because the tongue 364 is integrally formed as a part of actuating member 36, and blocks the retraction of main latch 34 from the protruded position when the door is completely closed, the present lock is relatively stronger and more thief-resistant. Through the above description, it should now be readily apparent how and why the present invention achieves the objects it contemplates.

What is claimed is:

1. A fire-escape door lock, comprising:

a housing having a base and a mounting frame;

a main latch pivotally mounted on said mounting frame and capable of moving pivotally between a protruded position where said main latch protrudes from said housing and a retracted position where said main latch is retracted into said housing, said main latch having a front part provided with an inner recess, a rear part, and a lower part;

a first torsion spring for urging said main latch to move pivotally toward said protruded position;

an auxiliary latch pivotally mounted on said mounting frame and disposed on one side of said main latch, said auxiliary latch being capable of moving pivotally between a protruded position where said auxiliary latch protrudes from said housing and a retracted position where said auxiliary latch is retracted into said housing, said auxiliary latch having a side projection;

a second torsion spring for urging said auxiliary latch to move pivotally toward said protruded position;

an actuating member pivotally mounted on said mounting frame and having a front end and a rear end, said front end having integrally formed therewith a tongue and a finger, said finger having a first part and second part, said actuating member being capable of moving pivotally between an, unlocking position where said tongue engages with a lower surface of said rear part of said main latch to keep said main latch at said retracted position, and a first stop position where said auxiliary latch is at said protruded position wherein said actuating member is stopped by causing said first part of said finger to engage with said side projection of said auxiliary latch, and said tongue of said actuating member is disposed to correspond with said inner recess of said main latch, and a second stop position, where said auxiliary latch is at said retracted position and said actuating member is stopped by causing said second part of said finger to engage with said side projection of said auxiliary latch, said main latch is at said protruded position, and said tongue is disposed immediately behind said lower part of said main latch to block the retraction of said main latch from said protruded position, a third torsion spring for urging said actuating member to move pivotally towards said first stop position and said second stop position;

a push plate movably mounted with respect to said housing for operating said rear end of said actuating member; and a door strike plate to be fixed on to a door jamb, said door strike plate having a hole allowing said main latch to protrude and being adapted to keep said auxiliary latch at said retracted position when the door is completely closed.

2. The fire-escape door lock of claim 1, wherein said first part of said finger is a tip of said finger and said second part of said finger is a concave formed at a lower side of said finger and adjacent to said tip.

* * * * *